US008280079B2

(12) United States Patent
Chung et al.

(10) Patent No.: US 8,280,079 B2
(45) Date of Patent: Oct. 2, 2012

(54) PIEZOELECTRIC MICROSPEAKER AND METHOD OF FABRICATING THE SAME

(75) Inventors: Seok-whan Chung, Suwon-si (KR); Dong-kyun Kim, Suwon-si (KR); Byung-gil Jeong, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 757 days.

(21) Appl. No.: 12/430,652

(22) Filed: Apr. 27, 2009

(65) Prior Publication Data

US 2010/0074459 A1 Mar. 25, 2010

(30) Foreign Application Priority Data

Sep. 25, 2008 (KR) ..... 10-2008-0094096

(51) Int. Cl.
*H04R 25/00* (2006.01)

(52) U.S. Cl. ..... 381/190; 381/173

(58) Field of Classification Search ..... 381/173, 381/174, 175, 190, 191, 369; 310/311, 322; 367/155; 257/254, 415, 416, 418, 419
See application file for complete search history.

(56) References Cited

U.S. PATENT DOCUMENTS

| | | | | |
|---|---|---|---|---|
| 4,816,125 | A | 3/1989 | Muller et al. | |
| 5,209,118 | A | 5/1993 | Jerman | |
| 5,633,552 | A | 5/1997 | Lee et al. | |
| 6,857,501 | B1 | 2/2005 | Han et al. | |
| 6,967,362 | B2 | 11/2005 | Nam et al. | |
| 7,003,125 | B2 * | 2/2006 | Yi et al. | 381/190 |
| 7,089,638 | B2 | 8/2006 | Yi et al. | |
| 2003/0048914 | A1 * | 3/2003 | Yi et al. | 381/190 |
| 2003/0059068 | A1 * | 3/2003 | Bank et al. | 381/152 |
| 2007/0140514 | A1 * | 6/2007 | Pedersen | 381/150 |
| 2008/0172859 | A1 * | 7/2008 | Hutt et al. | 29/594 |
| 2009/0154734 | A1 | 6/2009 | Jeong et al. | |
| 2010/0072860 | A1 | 3/2010 | Kim et al. | |
| 2010/0156238 | A1 | 6/2010 | Kim et al. | |
| 2011/0038495 | A1 | 2/2011 | Jeong et al. | |
| 2011/0051985 | A1 | 3/2011 | Hwang et al. | |
| 2011/0064250 | A1 | 3/2011 | Jeong et al. | |
| 2011/0075867 | A1 | 3/2011 | Chung et al. | |
| 2011/0075879 | A1 | 3/2011 | Kim et al. | |
| 2011/0085684 | A1 | 4/2011 | Kim et al. | |

FOREIGN PATENT DOCUMENTS

| | | | |
|---|---|---|---|
| JP | 2001-25095 | A | 1/2001 |
| KR | 10-2003-0062897 | A | 7/2003 |
| KR | 10-2003-0062899 | A | 7/2003 |
| KR | 10-0466808 | B1 | 11/2003 |
| KR | 20030090189 | A | 11/2003 |
| KR | 10-0512960 | B1 | 4/2004 |
| KR | 20040026756 | A | 4/2004 |
| KR | 10-2005-0076150 | A | 7/2005 |
| KR | 10-0756532 | B1 | 8/2006 |
| KR | 20060093464 | A | 8/2006 |
| KR | 10-2006-0127013 | A | 12/2006 |

(Continued)

*Primary Examiner* — Tuan Nguyen
(74) *Attorney, Agent, or Firm* — Sughrue Mion, PLLC

(57) ABSTRACT

Provided are a piezoelectric microspeaker and a method of fabricating the same. In the piezoelectric microspeaker, a diaphragm includes a first region and a second region. The first region may be formed of a material capable of maximizing an exciting force, and the second region may be formed of a material having less initial stress and a lower Young's modulus than the first region.

5 Claims, 18 Drawing Sheets

FOREIGN PATENT DOCUMENTS

| | | | |
|---|---|---|---|
| KR | 20090063950 | A | 6/2009 |
| KR | 20100033807 | A | 3/2010 |
| KR | 20100034883 | A | 4/2010 |
| KR | 20100071607 | A | 6/2010 |
| KR | 20110016667 | A | 2/2011 |
| KR | 10-2011-0029812 | A | 3/2011 |
| KR | 10-2011-0033593 | A | 3/2011 |
| KR | 20110023535 | A | 3/2011 |
| KR | 10-2011-0034960 | A | 4/2011 |
| KR | 10-2011-0039815 | A | 4/2011 |
| WO | 2005/053357 | A1 | 6/2005 |

* cited by examiner

PIEZOELECTRIC MICROSPEAKER AND METHOD OF FABRICATING THE SAME

CROSS-REFERENCE TO RELATED APPLICATION

This application claims priority from Korean Patent Application No. 10-2008-0094096, filed on Sep. 25, 2008, the disclosure of which is incorporated herein in its entirety by reference.

BACKGROUND

1. Field

One or more embodiments relate to a microspeaker, and more particularly, to a micro-electro-mechanical systems (MEMS)-based piezoelectric microspeaker and a method of fabricating the same.

2. Description of the Related Art

The piezoelectric effect is the reversible conversion of mechanical energy into electrical energy using a piezoelectric material. In other words, the piezoelectric effect is a phenomenon in which a potential difference is generated when pressure or vibration is applied to a piezoelectric material, and the piezoelectric material deforms or vibrates when a potential difference is applied.

Piezoelectric speakers use the principle of applying a potential difference to a piezoelectric material to deform or vibrate the piezoelectric material and generating sound according to the vibration.

With the rapid progress of personal mobile communication, research on a subminiature acoustic transducer has been carried out for several decades. In particular, piezoelectric microspeakers have been researched due to their simple structures and ability to operate at low voltage.

In general, a piezoelectric microspeaker includes a piezoelectric plate on both sides of which electrode layers are formed, and a diaphragm which is not piezoelectric. When voltage is applied through the electrode layers, the piezoelectric plate is deformed, which causes the diaphragm to vibrate and generate sound.

However, since the piezoelectric microspeaker has a lower sound output level than a voice coil microspeaker, there are few cases of it being put to practical use. Thus, a piezoelectric microspeaker which has a small size and a high sound output level is needed.

SUMMARY

A piezoelectric microspeaker, according to an embodiment, has a piezoelectric plate which deforms according to voltage applied thereto, and a diaphragm which vibrates due to deformation of the piezoelectric plate. The diaphragm includes a first region and a second region formed of different materials. The first region is formed of a material having substantially the same Young's modulus as a material of the piezoelectric plate, and the second region is formed of a material having a lower Young's modulus than the material of the first region.

A method of fabricating a piezoelectric microspeaker, according to an embodiment, includes: forming a diaphragm by depositing a thin insulating layer on a substrate; forming a lower electrode by depositing and etching a thin metal layer on the diaphragm, forming a piezoelectric plate by depositing and etching a thin piezoelectric layer on the lower electrode, and forming an upper electrode by depositing and etching a thin metal layer on the piezoelectric plate; etching and removing a part of the diaphragm; and depositing and etching a thin polymer layer, having a lower Young's modulus than the piezoelectric plate on a region of the substrate including a region from which the part of the diaphragm has been removed.

Another method of fabricating a piezoelectric microspeaker, according to an embodiment, includes: forming an etch stop layer on a first surface of a substrate, forming a diaphragm by depositing a thin insulating layer on a second surface of the substrate; forming a lower electrode by depositing and etching a thin metal layer on the diaphragm; forming a piezoelectric plate by depositing and etching a thin piezoelectric layer on the lower electrode; forming an upper electrode by depositing and etching a thin metal layer on the piezoelectric plate; depositing and etching a thin polymer layer having a lower Young's modulus than the piezoelectric plate; releasing the diaphragm by etching a part of the substrate from the first side of the substrate; etching and removing a part of the diaphragm exposed to the first side of the substrate; and removing the etch stop layer.

Another method of fabricating a piezoelectric microspeaker, according to an embodiment, includes: forming a diaphragm by depositing a thin insulating layer on a substrate; forming a lower electrode by depositing and etching a thin metal layer on the diaphragm; forming a piezoelectric plate by depositing and etching a thin piezoelectric layer on the lower electrode; forming an upper electrode by depositing and etching a thin metal layer on the piezoelectric plate; releasing the diaphragm by etching a part of the substrate from a lower side of the substrate; depositing a thin polymer layer having a lower Young's modulus than the piezoelectric plate through the etched part of the substrate; and etching; and removing a part of the diaphragm.

The first region of the diaphragm may be directly under the piezoelectric plate, and the second region of the diaphragm may be the entirety or a part of the diaphragm excluding the first region. The piezoelectric plate and the first region of the diaphragm formed of a material having a similar Young's modulus to the material of the piezoelectric plate may have a Young's modulus of about 50 Gpa to 500 Gpa, and the second region of the diaphragm may have a Young's modulus of about 100 Mpa to 5 Gpa, which is lower than that of the first region.

It is to be understood that both the foregoing general description and the following detailed description are exemplary and explanatory and are intended to provide further explanation of the embodiments.

BRIEF DESCRIPTION OF THE DRAWINGS

The above and/or other aspects will become apparent and more readily appreciated from the following description of the embodiments, taken in conjunction with the accompanying drawings of which.

DETAILED DESCRIPTION

Figure 1:
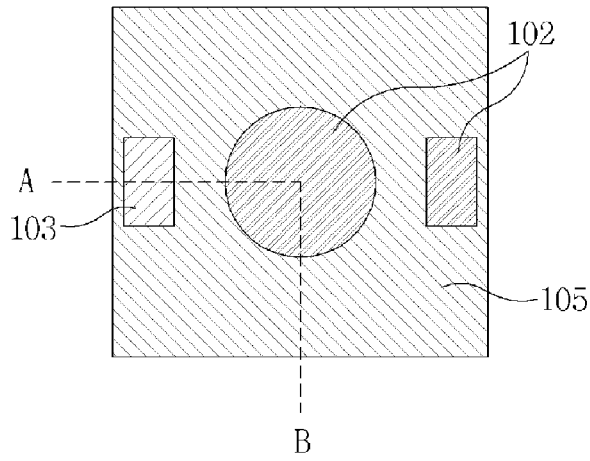
FIG. 1 is a plan view of a piezoelectric microspeaker according to an embodiment.

Embodiments will be described more fully hereinafter with reference to the accompanying drawings. The general inventive concept may, however, be embodied in many different forms and should not be construed as limited to the embodiments set forth herein. Rather, these embodiments are provided so that this disclosure is thorough, and will fully convey the scope of the general inventive concept to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
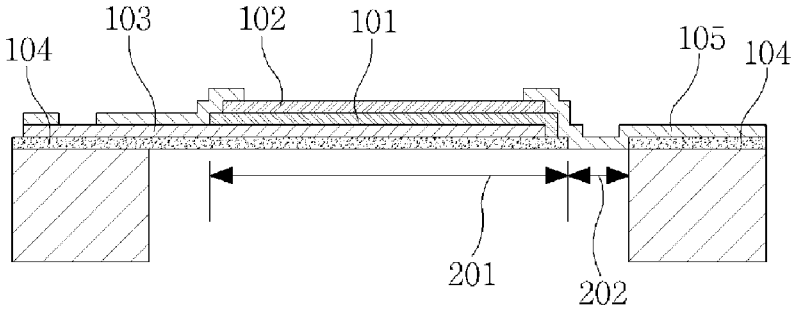
FIG. 2 is a cross-sectional view of the piezoelectric microspeaker according to the embodiment of FIG. 1.

FIG. 1 is a plan view of a piezoelectric microspeaker according to an embodiment, and FIG. 2 is a cross-sectional view taken along line A-B of FIG. 1.

Referring to FIGS. 1 and 2, the piezoelectric microspeaker according to this embodiment may include a piezoelectric plate 101 which deforms according to a voltage applied to upper and lower electrodes 102 and 103 and a diaphragm 104 which vibrates due to deformation of the piezoelectric plate 101.

When voltage is applied to the piezoelectric plate 101 through the upper and lower electrodes 102 and 103, the piezoelectric plate 101 deforms according to the voltage. Deformation of the piezoelectric plate 101 causes the diaphragm 104 to vibrate and generate sound.

The diaphragm 104 may include a first region 201 and a second region 202. For example, the first region 201 may be directly under the piezoelectric plate 101, and the second region 202 may be the whole or a part of the diaphragm 104 excluding the first region 201.

The first region 201 and the second region 202 may be formed of materials having different Young's moduli. For example, the first region 201 may be formed of a material having a Young's modulus similar to that of the piezoelectric plate 101, and the second region 202 may be formed of a material having a Young's modulus lower than that of the first region 201.

For example, the piezoelectric plate 101 may be formed of a thin aluminum nitride (AlN) layer or a thin zinc oxide (ZnO) layer having a Young's modulus of about 50 Gpa to 500 Gpa. The first region 201 of the diaphragm 104 may be formed of silicon nitride (SiN) having a Young's modulus similar to that of the piezoelectric plate 101, and the second region 202 of the diaphragm 104 may be formed of a thin polymer layer 105 having a Young's modulus of about 100 Mpa to 5 Gpa.

In the piezoelectric microspeaker according to this embodiment, the center of the diaphragm 104 is formed of a material having a similar Young's modulus to the piezoelectric plate 101, and the edge of the diaphragm 104 is formed of a soft material having a lower Young's modulus than the center. Thus, the piezoelectric microspeaker according to this embodiment may be called a microspeaker having a soft edge.

Since the region of the diaphragm 104 directly under the piezoelectric plate 101 is formed of the material having a Young's modulus similar to that of the piezoelectric plate 101 and the other region of the diaphragm 104 is formed of the material having a Young's modulus lower than that of the region, deformation efficiency of the diaphragm 104 can be improved, and an output sound pressure level can be increased by reducing structural stiffness.

FIGS. 3A to 3G are cross-sectional views illustrating a method of fabricating a piezoelectric microspeaker according to an embodiment. These may be an example of a method of fabricating the piezoelectric microspeaker of FIG. 2.

The method of fabricating the piezoelectric microspeaker according to this embodiment will be described below with reference to FIGS. 3A to 3G.

Figure 3A:
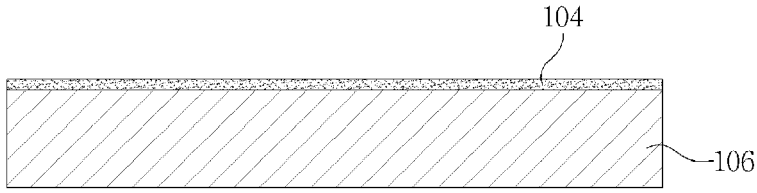
FIGS. 3A to 3G are cross-sectional views illustrating a method of fabricating the piezoelectric microspeaker according to the embodiment of FIG. 1.

First, as illustrated in FIG. 3A, the diaphragm 104 is formed on a silicon substrate 106. For example, the diaphragm 104 may be formed by depositing low-stress silicon nitride to a thickness of about 0.5 μm to 3 μm using a chemical vapor deposition (CVD) process.

Figure 3B:
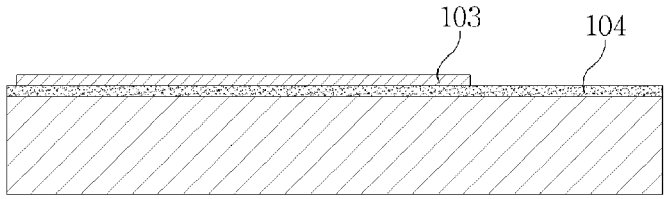

Subsequently, as illustrated in FIG. 3B, the lower electrode 103 is formed on the diaphragm 104. For example, the lower electrode 103 may be formed by depositing a metal, such as Au, Mo, Cu or Al, to a thickness of about 0.1 μm to 3 μm using sputtering or evaporation, and patterning the deposited layer.

Figure 3C:
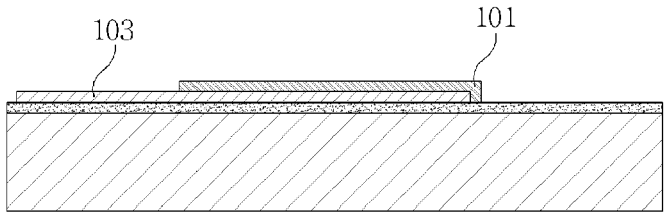

Subsequently, as illustrated in FIG. 3C, the piezoelectric plate 101 is formed on the lower electrode 103. For example, the piezoelectric plate 101 may be formed by depositing a piezoelectric material, such as AlN or ZnO, to a thickness of about 0.1 μm to 3 μm using a sputtering process and patterning the deposited layer.

Figure 3D:
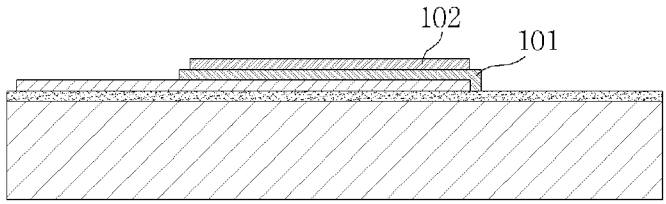

Subsequently, as illustrated in FIG. 3D, the upper electrode 102 is formed on the piezoelectric plate 101. For example, the upper electrode 102 may be formed by depositing a metal, such as Au, Mo, Cu or Al, to a thickness of about 0.1 μm to 3 μm using sputtering or evaporation, and patterning the deposited layer.

Figure 3E:
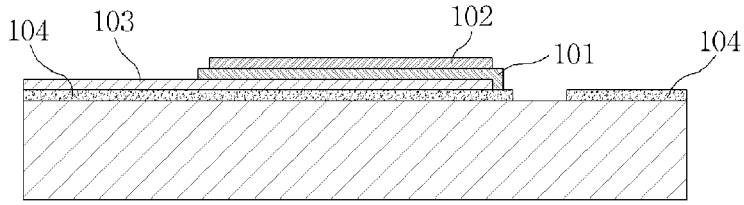

Subsequently, as illustrated in FIG. 3E, a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and provides a space in which the above-mentioned second region 202 will be formed.

Figure 3F:
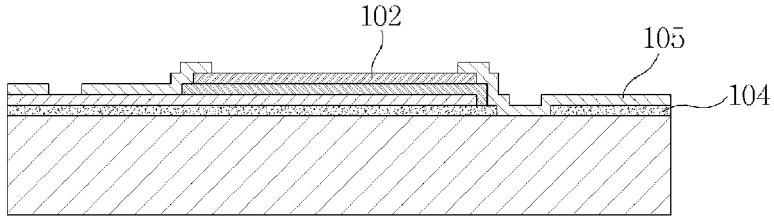

Subsequently, as illustrated in FIG. 3F, the thin polymer layer 105 is deposited on the entire substrate 106 including a region from which the part of the diaphragm 104 is removed, and is selectively removed. For example, parylene is deposited to a thickness of about 0.5 μm to 10 μm, and then the deposited parylene can be selectively removed by $O_2$ plasma etching using photoresist as an etch mask. Here, parylene deposited on the upper electrode 102 is removed to expose the upper electrode 102 to outside.

Figure 3G:
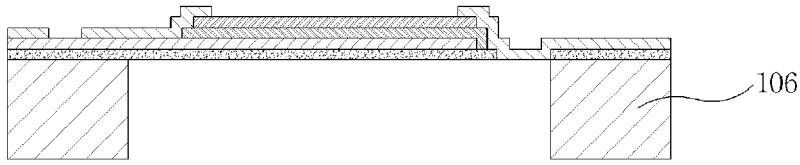

Finally, as illustrated in FIG. 3G, a part of the substrate 106 is etched from the lower side to release the diaphragm 104.

Figure 4:
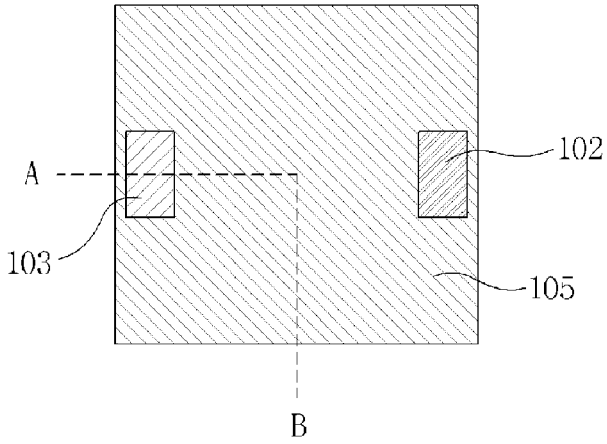
FIG. 4 is a plan view of a piezoelectric microspeaker according to another embodiment.
Figure 5:
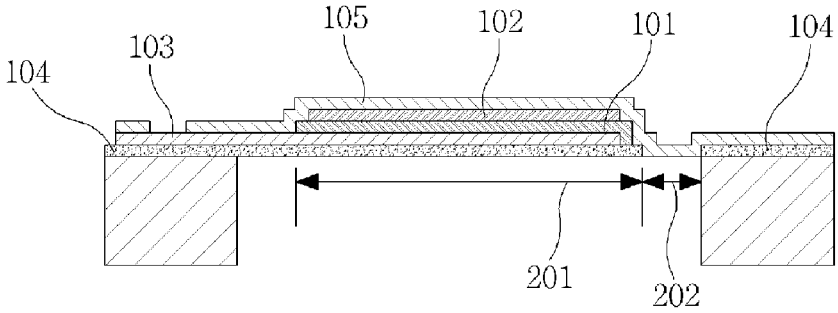
FIG. 5 is a cross-sectional view of the piezoelectric microspeaker illustrated in FIG. 4 according to the embodiment of FIG. 4.

FIG. 4 is a plan view of a piezoelectric microspeaker according to another embodiment, and FIG. 5 is a cross-sectional view taken along line A-B of FIG. 4.

Referring to FIGS. 4 and 5, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. This is the same as described with reference to FIGS. 1 and 2.

However, while the thin polymer layer 105 deposited on the upper electrode 102 is selectively removed to externally expose the upper electrode 102 in the structure of FIG. 2, the upper electrode 102 is not externally exposed in the structure of FIG. 5.

FIGS. 6A to 6G are cross-sectional views illustrating a method of fabricating a piezoelectric microspeaker according to the embodiment of FIG. 4. This may be an example of a method of fabricating the piezoelectric microspeaker of FIG. 5.

The method of fabricating the piezoelectric microspeaker according to this embodiment will be described below with reference to FIGS. 6A to 6G.

Figure 6A:
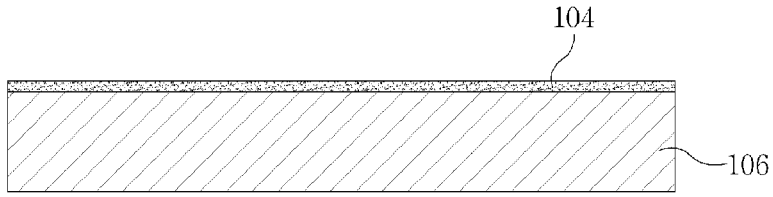
FIGS. 6A to 6G are cross-sectional views illustrating a method of fabricating the piezoelectric microspeaker according to the embodiment of FIG. 4.

First, as illustrated in FIG. 6A, the diaphragm 104 is formed on a silicon substrate 106. For example, the diaphragm 104 may be formed by depositing low-stress silicon nitride to a thickness of about 0.5 μm to 3 μm using a CVD process.

Figure 6B:
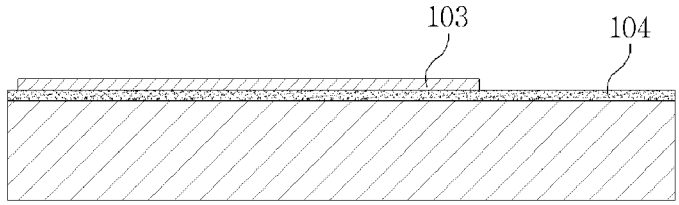

Subsequently, as illustrated in FIG. 6B, the lower electrode 103 is formed on the diaphragm 104. For example, the lower electrode 103 may be formed by depositing a metal, such as Au, Mo, Cu or Al, to a thickness of about 0.1 μm to 3 μm using sputtering or evaporation, and patterning the deposited layer.

Figure 6C:
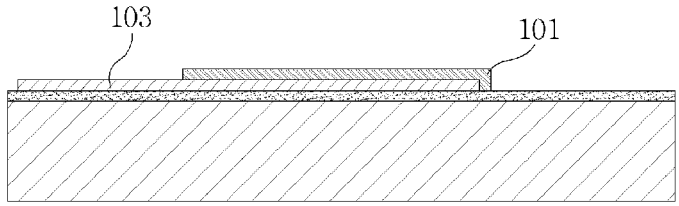

Subsequently, as illustrated in FIG. 6C, the piezoelectric plate 101 is formed on the lower electrode 103. For example, the piezoelectric plate 101 may be formed by depositing a piezoelectric material, such as AlN or ZnO, to a thickness of about 0.1 μm to 3 μm using a sputtering process and patterning the deposited layer.

Figure 6D:
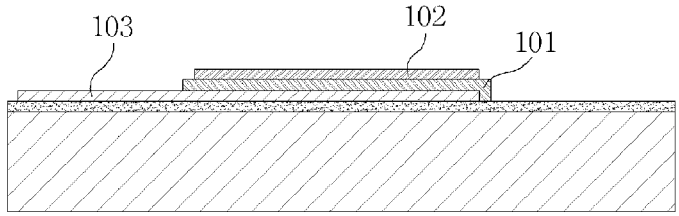

Subsequently, as illustrated in FIG. 6D, the upper electrode 102 is formed on the piezoelectric plate 101. For example, the upper electrode 102 may be formed by depositing a metal, such as Au, Mo, Cu or Al, to a thickness of about 0.1 μm to 3 μm using sputtering or evaporation, and patterning the deposited layer.

Figure 6E:
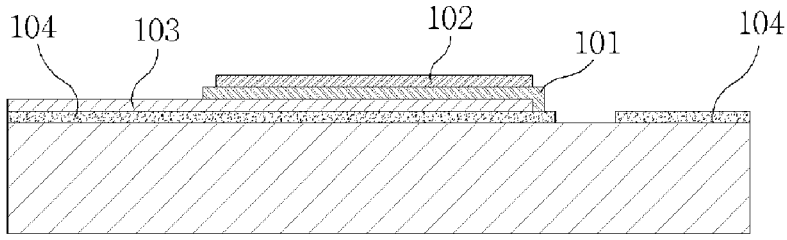

Subsequently, as illustrated in FIG. 6E, a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and provides a space in which the above-mentioned second region 202 will be formed.

Figure 6F:
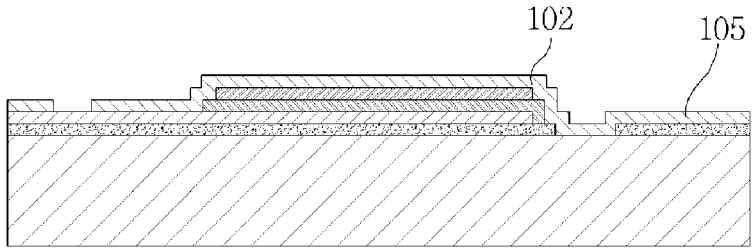

Subsequently, as illustrated in FIG. 6F, a thin polymer layer 105 is deposited on the entire substrate 106 including a region from which the part of the diaphragm 104 is removed, and is selectively removed. For example, parylene is deposited to a thickness of about 0.5 μm to 110 μm, and then the deposited parylene can be selectively removed by O2 plasma etching using photoresist as an etch mask. Here, parylene deposited on the upper electrode 102 is not etched so as not to expose the upper electrode 102 to outside.

Figure 6G:
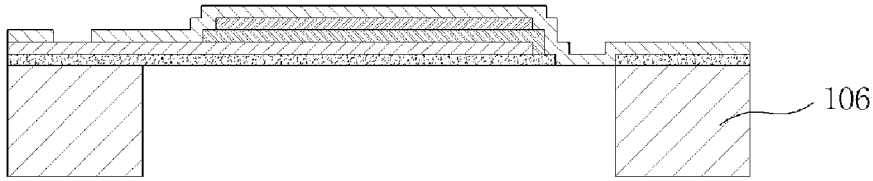

Finally, as illustrated in FIG. 6G, a part of the substrate 106 is etched from the lower side to release the diaphragm 104.

Figure 7:
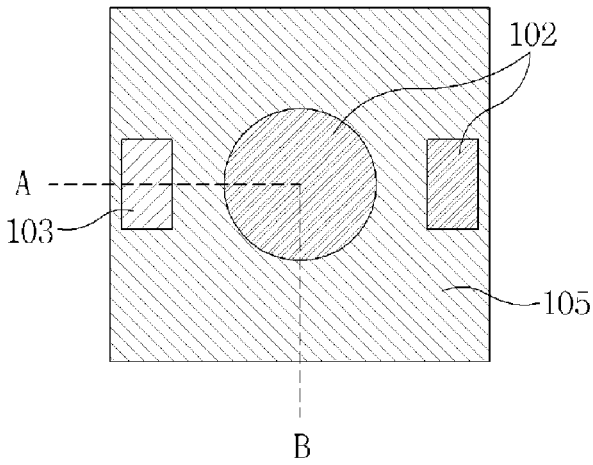
FIG. 7 is a plan view of a piezoelectric microspeaker according to another embodiment.
Figure 8:
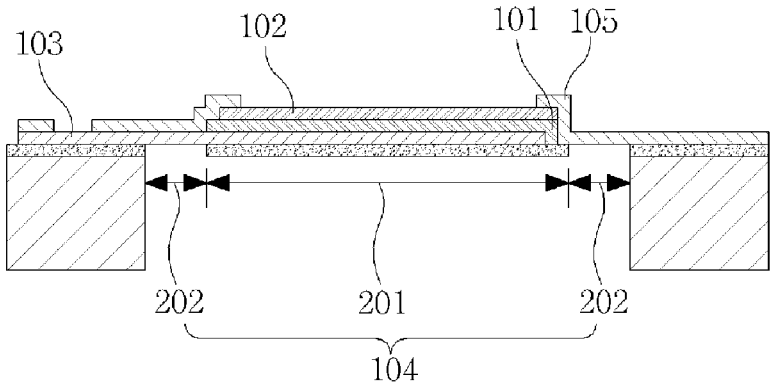
FIG. 8 is a cross-sectional view of the piezoelectric microspeaker according to the embodiment of FIG. 7.

FIG. 7 is a plan view of a piezoelectric microspeaker according to another embodiment, and FIG. 8 is a cross-sectional view taken along line A-B of FIG. 7.

Referring to FIGS. 7 and 8, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. For example, the second region 202 may be understood as a region from which a part of the diaphragm 104 is removed and filled with a thin polymer layer 105.

FIGS. 9A to 9F are cross-sectional views illustrating a method of fabricating the piezoelectric microspeaker according to this embodiment. This may be an example of a method of fabricating the piezoelectric microspeaker of FIG. 8.

The method of fabricating the piezoelectric microspeaker according to this embodiment will be described below with reference to FIGS. 9A to 9F.

Figure 9A:
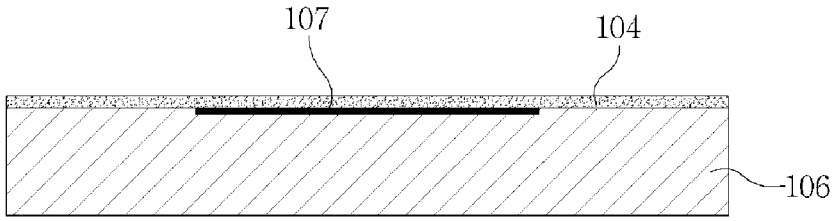
FIGS. 9A to 9F are cross-sectional views illustrating a method of fabricating the piezoelectric microspeaker according to the embodiment of FIG. 7.

First, as illustrated in FIG. 9A, an etch stop layer 107 is formed on a substrate 106, and the diaphragm 104 is formed on the substrate 106. Here, the diaphragm 104 may be formed by depositing low-stress silicon nitride.

Figure 9B:
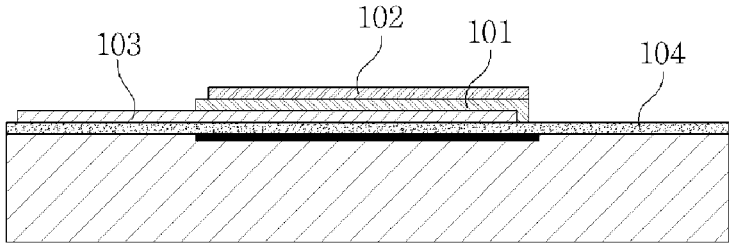

Subsequently, as illustrated in FIG. 9B, the lower electrode 103 is formed by depositing and etching a thin metal layer on the diaphragm 104, the piezoelectric plate 101 is formed by depositing and etching a thin piezoelectric layer on the lower electrode 103, and then the upper electrode 102 is formed by again depositing and etching a thin metal layer on the piezoelectric plate 101.

Figure 9C:
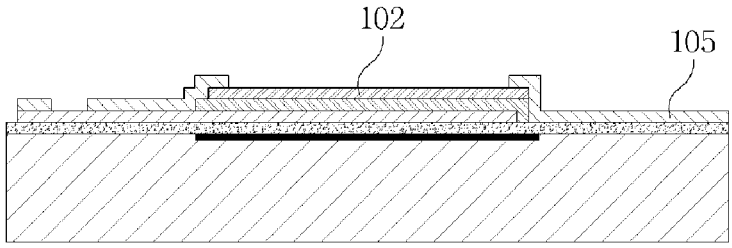

Subsequently, as illustrated in FIG. 9C, the thin polymer layer 105 is deposited on the entire substrate 106 and selectively removed. At this time, the removed part may include a part on the upper electrode 102. The thin polymer layer 105 may be a thin parylene layer having a lower Young's modulus than the piezoelectric plate 101.

Figure 9D:
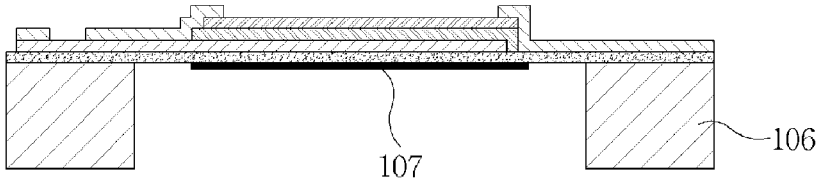

Subsequently, as illustrated in FIG. 9D, a part of the substrate 106 is etched from the lower side to release the etch stop layer 107 and the diaphragm 104.

Figure 9E:
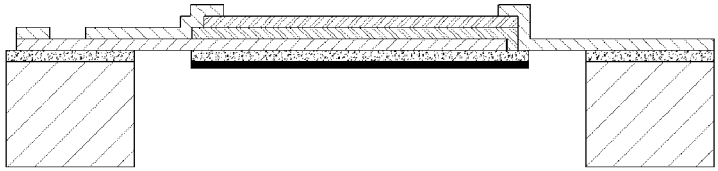

Subsequently, as illustrated in FIG. 9E, a part of the diaphragm 104 is removed. For example, the diaphragm 104 excluding a part on which the etch stop layer 107 is formed can be removed by etching the diaphragm 104 from the lower side of the substrate 106.

Figure 9F:
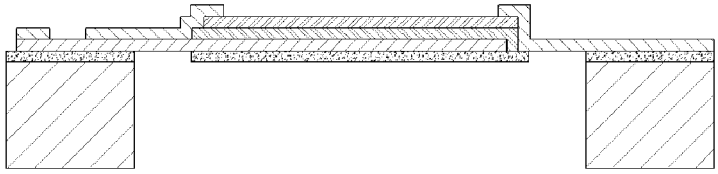

Finally, as illustrated in FIG. 9F, the etch stop layer 107 is removed.

Figure 10:
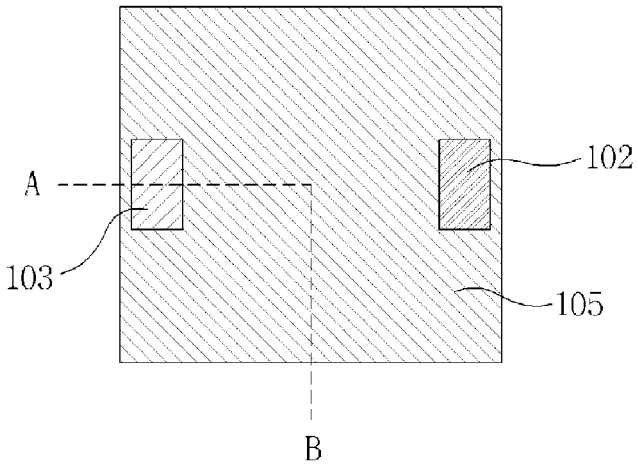
FIG. 10 is a plan view of a piezoelectric microspeaker according to another embodiment.
Figure 11:
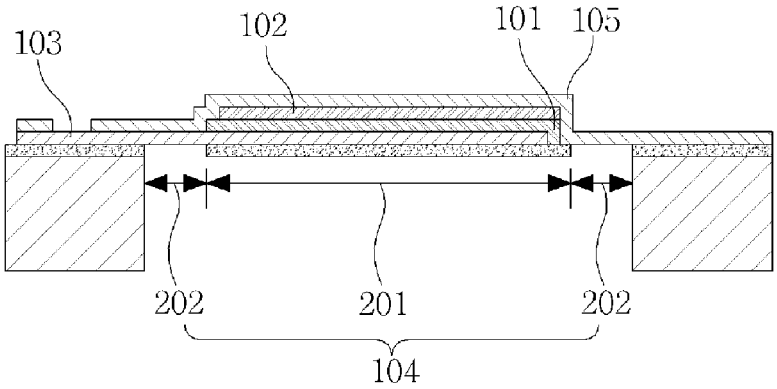
FIG. 11 is a cross-sectional view of the piezoelectric microspeaker according to the embodiment of FIG. 10.

FIG. 10 is a plan view of a piezoelectric microspeaker according to another embodiment, and FIG. 11 is a cross-sectional view taken along line A-B of FIG. 10.

Referring to FIGS. 10 and 11, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. This is the same as described with reference to FIGS. 7 and 8.

However, while the thin polymer layer 105 deposited on the upper electrode 102 is selectively removed to expose the upper electrode 102 to outside in the structure of FIG. 8, the upper electrode 102 is not exposed to outside in the structure of FIG. 11.

FIGS. 12A to 12F are cross-sectional views illustrating a method of fabricating the piezoelectric microspeaker according to the embodiment of FIG. 10.

The method of fabricating the piezoelectric microspeaker according to this embodiment will be described below with reference to FIGS. 12A to 12F.

Figure 12A:
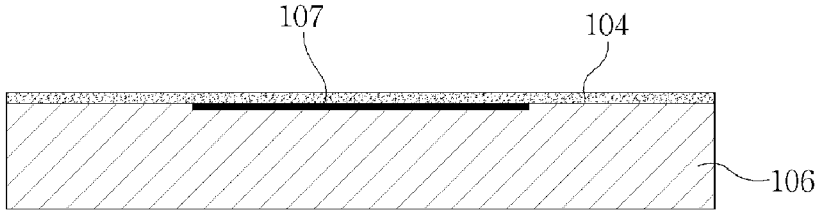
FIGS. 12A to 12F are cross-sectional views illustrating a method of fabricating the piezoelectric microspeaker according to the embodiment of FIG. 10.

First, as illustrated in FIG. 12A, an etch stop layer 107 is formed on a substrate 106, and a diaphragm 104 is formed on the substrate 106. Here, the diaphragm 104 may be formed by depositing low-stress silicon nitride.

Figure 12B:
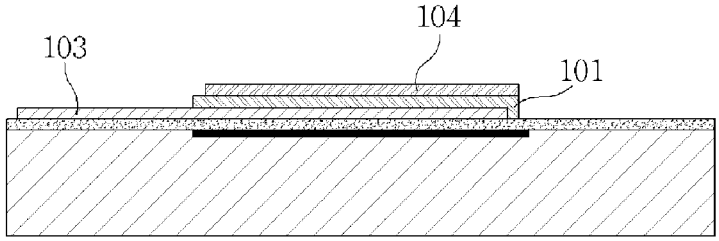

Subsequently, as illustrated in FIG. 12B, the lower electrode 103 is formed by depositing and etching a thin metal layer on the diaphragm 104, the piezoelectric plate 101 is formed by depositing and etching a thin piezoelectric layer on the lower electrode 103, and then the upper electrode 102 is formed by again depositing and etching a thin metal layer on the piezoelectric plate 101.

Figure 12C:
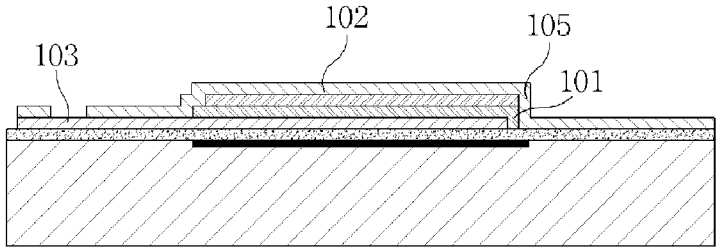

Subsequently, as illustrated in FIG. 12C, a thin polymer layer 105 is deposited on the entire substrate 106 and selectively removed. At this time, the thin polymer layer 105 deposited on the upper electrode may not be removed, and thus it is possible not to expose the upper electrode 102 to outside. The thin polymer layer 105 may be a thin parylene layer having a lower Young's modulus than the piezoelectric plate 101.

Figure 12D:
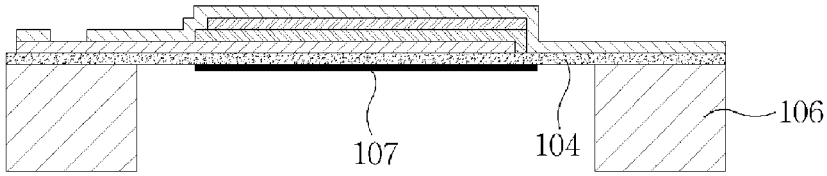

Subsequently, as illustrated in FIG. 12D, a part of the substrate 106 is etched from the lower side to release the etch stop layer 107 and the diaphragm 104.

Figure 12E:
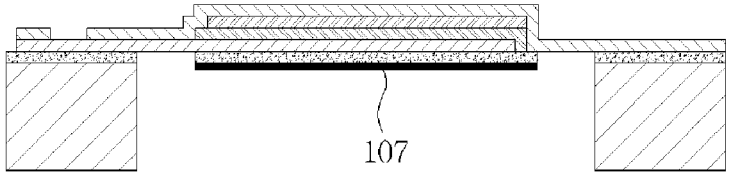

Subsequently, as illustrated in FIG. 12E, a part of the diaphragm 104 is removed. For example, the diaphragm 104 excluding a part on which the etch stop layer 107 is formed can be removed by etching the diaphragm 104 from the lower side of the substrate 106. Here, the removed part of the diaphragm 104 may be a space in which the above-mentioned second region 202 will be formed.

Figure 12F:
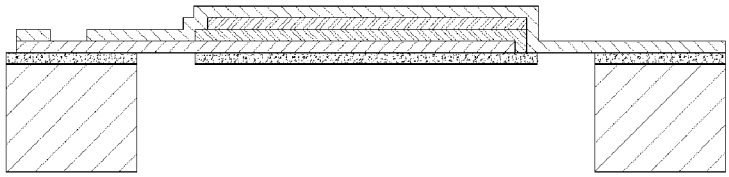

Finally, as illustrated in FIG. 12F, the etch stop layer 107 is removed.

Figure 13:
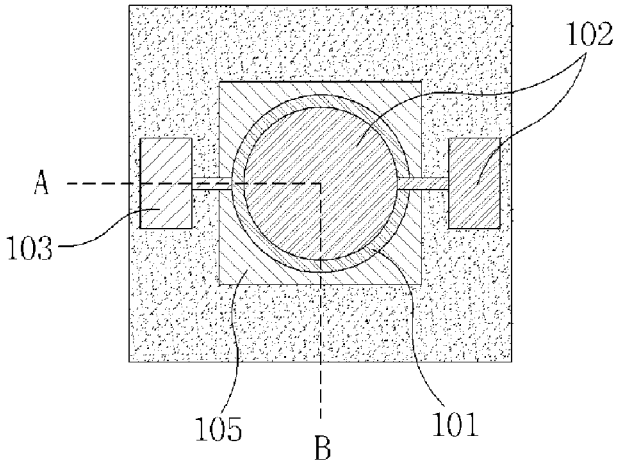
FIG. 13 is a plan view of a piezoelectric microspeaker according to another embodiment.
Figure 14:
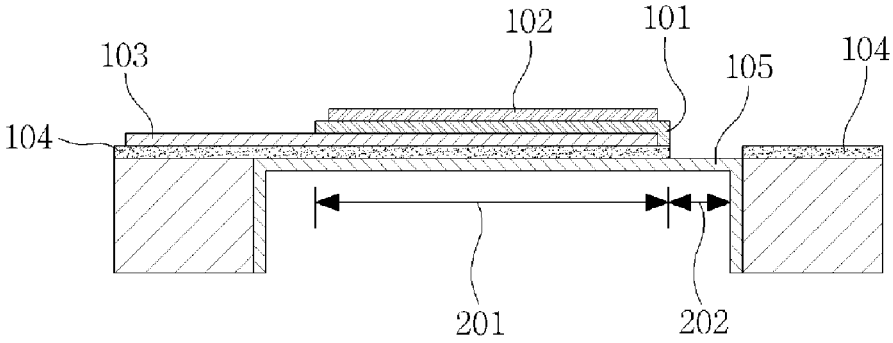
FIG. 14 is a cross-sectional view of the piezoelectric microspeaker according to the embodiment of FIG. 13.

FIG. 13 is a plan view of a piezoelectric microspeaker according to another embodiment, and FIG. 14 is a cross-sectional view taken along line A-B of FIG. 13.

Referring to FIGS. 13 and 14, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a similar Young's modulus to the piezoelectric plate 101, and the second region 202 may be formed of a material having a lower Young's modulus than the first region 201. For example, the second region 202 may be understood as a region from which a part of the diaphragm 104 is removed and filled with a thin polymer layer 105.

FIGS. 15A to 15E are cross-sectional views illustrating a method of fabricating a piezoelectric microspeaker according to the embodiment of FIG. 13.

The method of fabricating the piezoelectric microspeaker according to this embodiment will be described below with reference to FIGS. 15A to 15F.

Figure 15A:
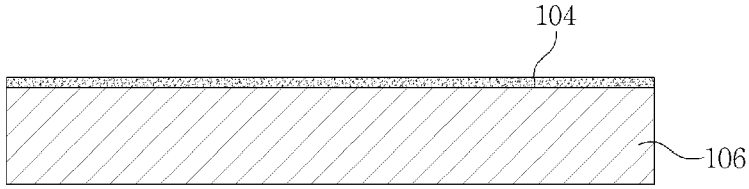
FIGS. 15A to 15E are cross-sectional views illustrating a method of fabricating the piezoelectric microspeaker according to the embodiment of FIG. 13.

First, as illustrated in FIG. 15A, the diaphragm 104 is formed on a substrate 106. For example, the diaphragm 104 may be formed by depositing low-stress silicon nitride to a thickness of about 0.5 μm to 3 μm using a CVD process.

Figure 15B:
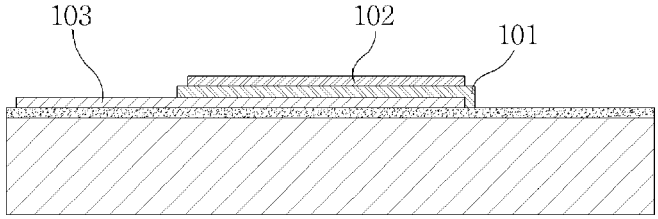

Subsequently, as illustrated in FIG. 15B, the lower electrode 103 is formed by depositing and etching a thin metal layer on the diaphragm 104, the piezoelectric plate 101 is formed by depositing and etching a thin piezoelectric layer on the lower electrode 103, and then the upper electrode 102 is formed by again depositing and etching a thin metal layer on the piezoelectric plate 101.

Figure 15C:
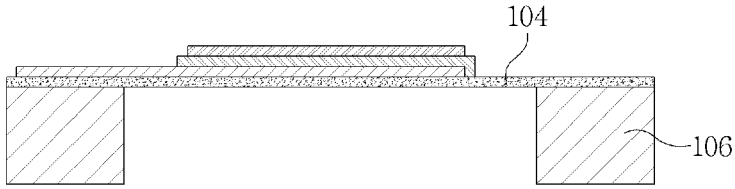

Subsequently, as illustrated in FIG. 15C, a part of the substrate 106 is etched from the lower side to release the diaphragm 104.

Figure 15D:
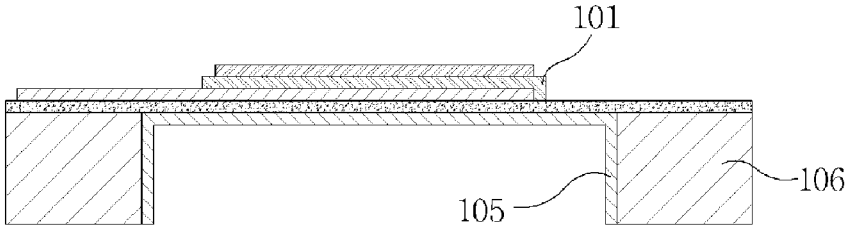

Subsequently, as illustrated in FIG. 15D, the thin polymer layer 105 is formed on the released diaphragm 104 through the etched part of the substrate 106. For example, the thin polymer layer 105 may be formed by depositing parylene having a lower Young's modulus than the piezoelectric plate 101 on the etched part of the substrate 106 and the released diaphragm 104.

Figure 15E:
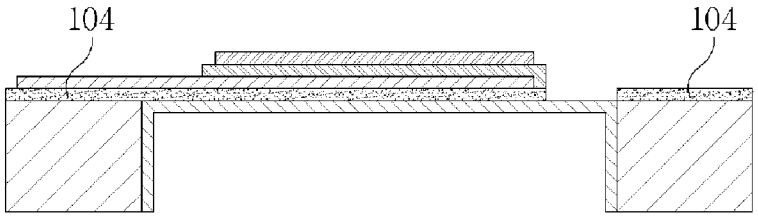

Finally, as illustrated in FIG. 15E, a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and may be the above-mentioned second region 202.

Figure 16:
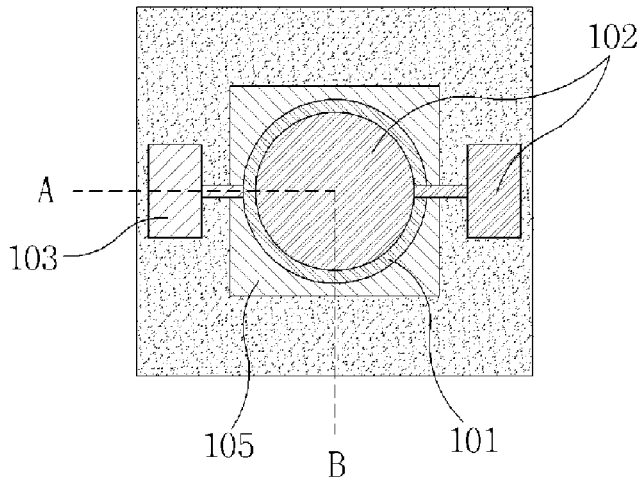
FIG. 16 is a plan view of a piezoelectric microspeaker according to another embodiment.
Figure 17:
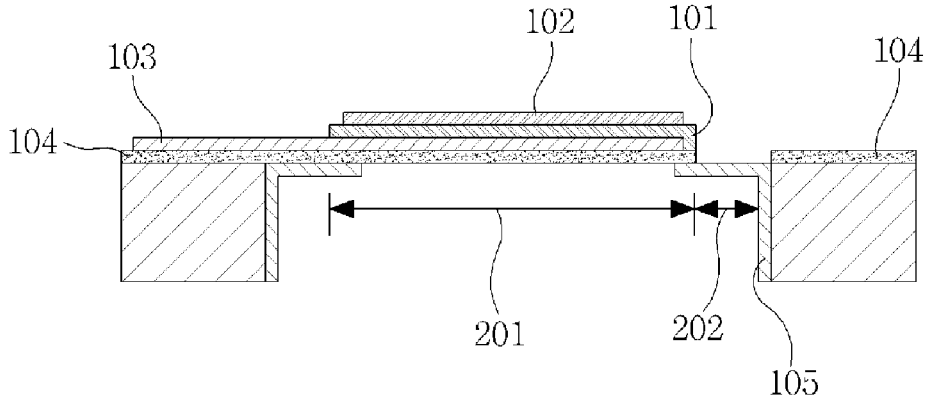
FIG. 17 is a cross-sectional view of the piezoelectric microspeaker according to the embodiment of FIG. 16.

FIG. 16 is a plan view of a piezoelectric microspeaker according to another embodiment, and FIG. 17 is a cross-sectional view taken along line A-B of FIG. 16.

Referring to FIGS. 16 and 17, the piezoelectric microspeaker according to this embodiment has the same structure as described with reference to FIGS. 13 and 14 except that a thin polymer layer 105 is selectively removed. In other words, in the piezoelectric microspeaker according to this embodiment, the thin polymer layer 105 is selectively etched to expose a part of a diaphragm 104.

FIGS. 18A to 18E are cross-sectional views illustrating a method of fabricating a piezoelectric microspeaker according to the embodiment of FIG. 16.

The method of fabricating the piezoelectric microspeaker according to this embodiment will be described below with reference to FIGS. 17 and 18.

Figure 18A:
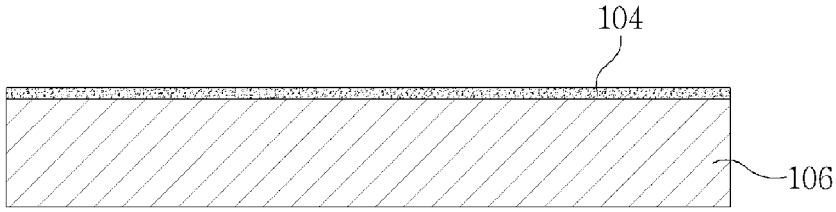
FIGS. 18A to 18F are cross-sectional views illustrating a method of fabricating the piezoelectric microspeaker according to the embodiment of FIG. 16.

First, as illustrated in FIG. 18A, the diaphragm 104 is formed on a substrate 106. For example, the diaphragm 104 may be formed by depositing low-stress silicon nitride to a thickness of about 0.5 μm to 3 μm using a CVD process.

Figure 18B:
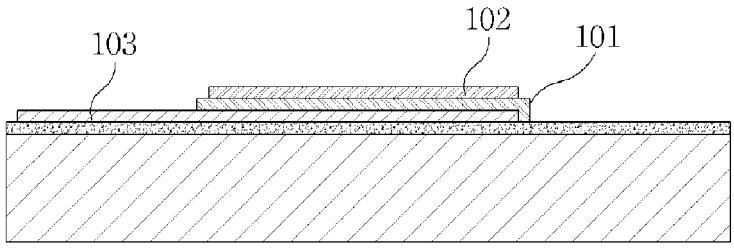

Subsequently, as illustrated in FIG. 18B, a lower electrode 103 is formed by depositing and etching a thin metal layer on the diaphragm 104, a piezoelectric plate 101 is formed by depositing and etching a thin piezoelectric layer on the lower electrode 103, and then an upper electrode 102 is formed by again depositing and etching a thin metal layer on the piezoelectric plate 101.

Figure 18C:
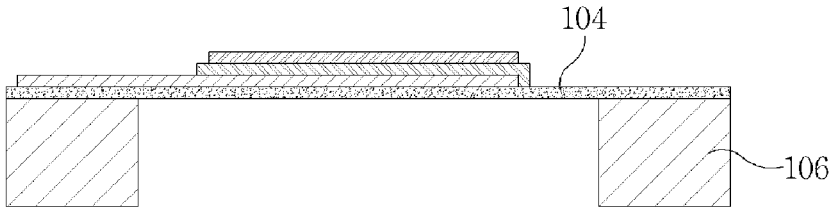

Subsequently, as illustrated in FIG. 18C, a part of the substrate 106 is etched from the lower side to release the diaphragm 104.

Figure 18D:
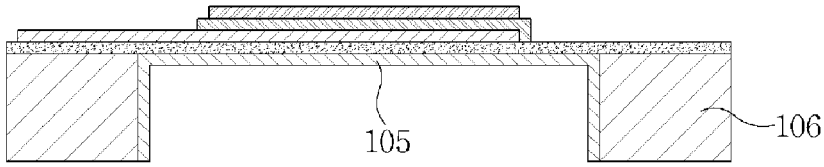

Subsequently, as illustrated in FIG. 18D, the thin polymer layer 105 is formed on the released diaphragm 104 through the etched part of the substrate 106. For example, the thin polymer layer 105 may be formed by depositing parylene having a lower Young's modulus than the piezoelectric plate 101 on the etched part of the substrate 106 and the released diaphragm 104.

Figure 18E:
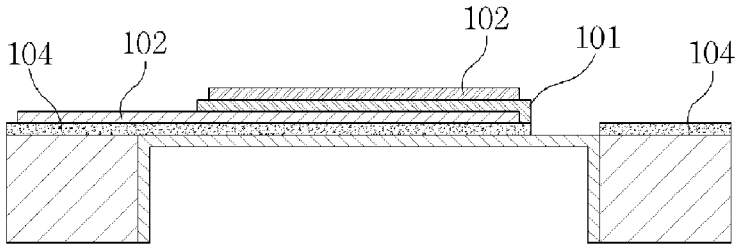

Subsequently, as illustrated in FIG. 18E, a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and may be the above-mentioned second region 202.

Figure 18F:
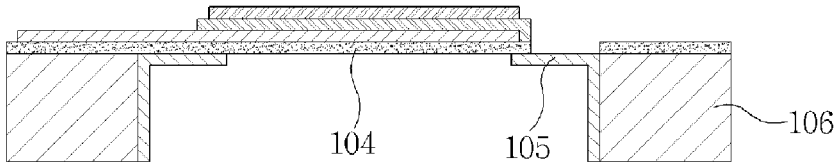

Finally, as illustrated in FIG. 18F, the thin polymer layer 105 under the diaphragm 104 is removed to expose the diaphragm 104 to outside.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A piezoelectric microspeaker comprising:

a piezoelectric plate which deforms according to a voltage applied thereto; and a diaphragm which vibrates due to deformation of the piezoelectric plate, wherein the diaphragm comprises a first region and a second region, wherein the first region is formed of a first material having a Young's modulus substantially the same as a Young's modulus of a material of the piezoelectric plate, and the second region is formed of a second material having a Young's modulus lower than the Young's modulus of the first material.

2. The piezoelectric microspeaker of claim 1, wherein the first region is disposed directly under the piezoelectric plate, and the second region is a region of the diaphragm excluding the first region.

3. The piezoelectric microspeaker of claim 1, wherein the Young's modulus of the first material and of the material of the piezoelectric plate is about 50 Gpa to 500 Gpa, and the Young's modulus of the second material is about 100 Mpa to 5 Gpa.

4. The piezoelectric microspeaker of claim 1, wherein the piezoelectric plate comprises a layer of aluminum nitride layer or zinc oxide.

5. The piezoelectric microspeaker of claim 1, wherein the second region comprises a polymer layer.

* * * * *